US005269046A

United States Patent [19]

Newby, Sr.

[11] Patent Number: 5,269,046

[45] Date of Patent: Dec. 14, 1993

[54] HINGE FOR MOLDED PLASTIC CASE

[75] Inventor: John P. Newby, Sr., Raleigh, N.C.

[73] Assignee: Southern Case, Inc., Raleigh, N.C.

[21] Appl. No.: 784,540

[22] Filed: Oct. 29, 1991

[51] Int. Cl.[5] ..... E05D 7/10

[52] U.S. Cl. ..... 16/267; 16/DIG. 13; 16/386

[58] Field of Search ..... 16/260, 266, 267, 268, 16/DIG. 13, 386

[56] References Cited

U.S. PATENT DOCUMENTS

| | | | |
|---|---|---|---|
| 770,595 | 9/1904 | Lovette | 16/260 |
| 771,654 | 10/1904 | Meek . | |
| 782,428 | 2/1905 | Struble et al. | 16/267 |
| 2,012,800 | 8/1935 | Allen | 16/172 |
| 2,677,479 | 5/1954 | Kiba | 220/31 |
| 2,963,734 | 12/1960 | Huget | 16/266 |
| 3,091,357 | 5/1963 | Weinhart | 220/31 |
| 3,126,120 | 3/1964 | Crate | 220/31 |
| 3,416,185 | 12/1968 | Peterson | 16/267 |
| 4,223,421 | 9/1980 | Wassenaar | 16/267 |
| 4,349,120 | 9/1982 | DiNardo | 220/337 |
| 4,515,424 | 5/1985 | Sakurai | 16/266 |
| 4,663,803 | 5/1987 | Gora | 16/266 |
| 4,688,146 | 8/1987 | Newmark et al. | 361/364 |
| 4,785,500 | 11/1988 | Langridge | 16/297 |
| 4,821,374 | 4/1989 | Gavagan | 16/321 |
| 4,930,753 | 6/1990 | Alvyn | 256/26 |
| 5,004,289 | 4/1991 | Lanser et al. | 296/97.12 |
| 5,070,577 | 12/1991 | Bonneville et al. | 16/267 |

*Primary Examiner*—Lowell A. Larson
*Assistant Examiner*—Donald M. Gurley
*Attorney, Agent, or Firm*—Bell, Seltzer, Park & Gibson

[57] ABSTRACT

The hinge includes a plurality of pintle members that are spaced from each other along the axis of the hinge and that are of generally semi-circular shape and have an arcuate outer surface on a first side thereof and a generally flat surface upon the opposite side thereof. The flat surfaces of some of the pintle members face in a direction opposite to that of the flat surfaces of other of the pintle members. The hinge further includes generally channel shaped knuckle members, some of which face in a first direction and other of which face in an opposite direction. Assembly of the hinge is effected by movement of the barrel and pintle members laterally into engagement with each other while maintaining confronting surfaces thereon in substantially coplanar relationship with each other.

3 Claims, 5 Drawing Sheets

HINGE FOR MOLDED PLASTIC CASE

FIELD OF THE INVENTION

This invention relates to hinges for pivotally interconnecting relatively movable members. The invention more specifically relates to an improved hinge for interconnecting adjacent components of a molded plastic case or similar article for pivotal movement about an axis.

BACKGROUND OF THE INVENTION

Molded plastic cases and similar articles frequently have components that are adapted to undergo relative pivotal movement about a pivot axis. In order to reduce the cost of manufacture and/or assembly of the molded plastic articles, it is highly desirable for at least one and preferably both of the hinge pintle and knuckle means to be formed integrally with the article components that are intended to undergo relative pivotal movement. Prior attempts to produce satisfactory hinges in this manner have frequently required the use of expensive and complex molds, the use of pins or other components that are not integral with the plastic case or similar article, and/or that require a "snap-fit" type of connection between the hinge pintle pin and knuckle members of the hinge.

SUMMARY OF THE INVENTION

The present provides an improved hinge construction, for pivotally interconnecting components of a molded plastic case or similar article for pivotal movement. The hinge includes cooperating pintle pin members and knuckle members that may be and are molded integrally with the plastic article components that are adapted to undergo relative pivotal movement, and that can be readily formed during the molding of such components without the use of expensive movable mold members. The pintle and knuckle members of the hinge may be quickly and easily brought into mating engagement with each other without subjecting them to the substantial forces and deflections required to effect connections of the snap-fit type. The assembled hinge provides stable pivotal movement between the interconnected components through any desired angle, the extent of the relative rotative movement between the components being limited only by engagement thereof with adjacent components of the plastic article.

DESCRIPTION OF THE PRIOR ART

The following U.S. patents may be of interest relative to the present invention: U.S. Pat. Nos. 771 654, 782,428, 2,012,800, 2,677,479, 3,091,357, 3,126,120, 4,349,120, 4,515,424, 4,688,146, 4,785,500, 4,821,374, 4,930,753, and 5,004,289.

DESCRIPTION OF THE PREFERRED EMBODIMENT

Figure 1:
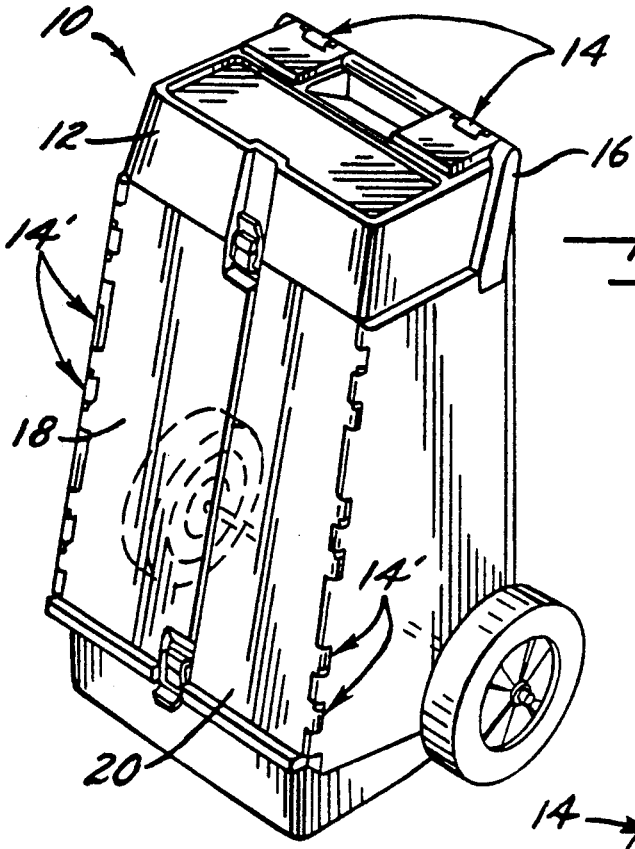
FIG. 1 is a top front right side perspective view of a molded plastic case having three hinges in accordance with the invention, one of the hinges interconnecting back and top cover components of the case, and the other hinges interconnecting door and side components of the case.
Figure 2:
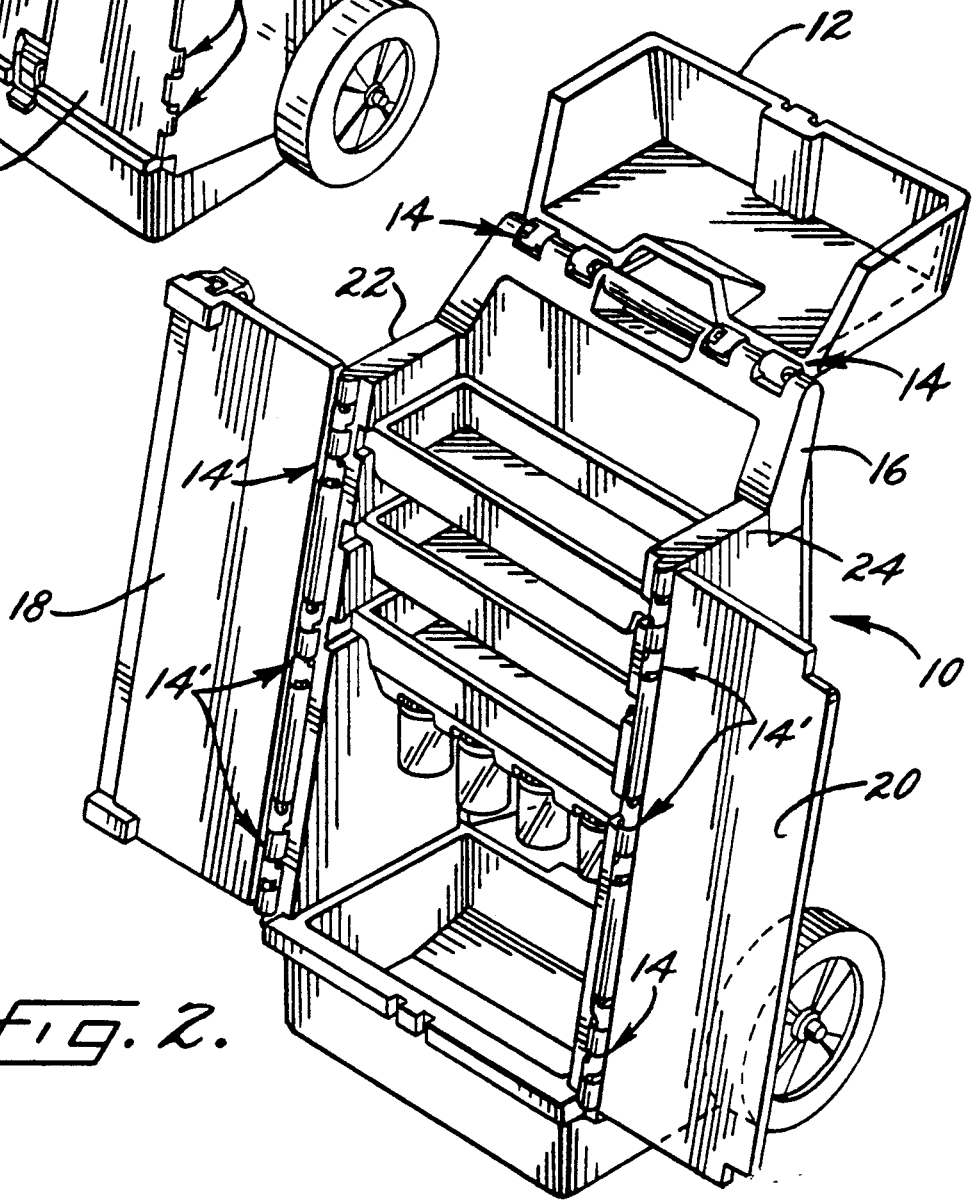
FIG. 2 is an enlarged view similar to FIG. 1 but showing the door and top cover components in open positions.

The case designated in its entirety in FIGS. 1 and 2 by the numeral 10 has a plurality of interconnected major components made of sturdy and durable plastic material. Such components preferably are formed by blow-molding but might instead be formed by other plastic forming means such as injection or rotational molding. The case components include an upper cover component 12 having a rear edge that is connected by hinge means 14 to the adjacent upper edge of a rear wall component 16 of the case. Cover component 12 is pivotally movable about the pivot axis of hinge means 14 through an angle of approximately 180° between a closed position shown in FIG. 1, and an open position shown in FIG. 2. Case 10 further includes left and right front door components 18, 20 that are respectively connected by hinge means 14' to thereto adjacent side wall components 22, 24 of case 10. Each door component 18, 20 is pivotally movable through an arc of approximately 180° between a closed position shown in FIG. 1, and an open position shown in FIG. 2. The range of pivotal movement of components 12, 18, 20 is limited only by the abutment of such components with other components of case 10, and not by the hinge means associated therewith.

Figure 3:
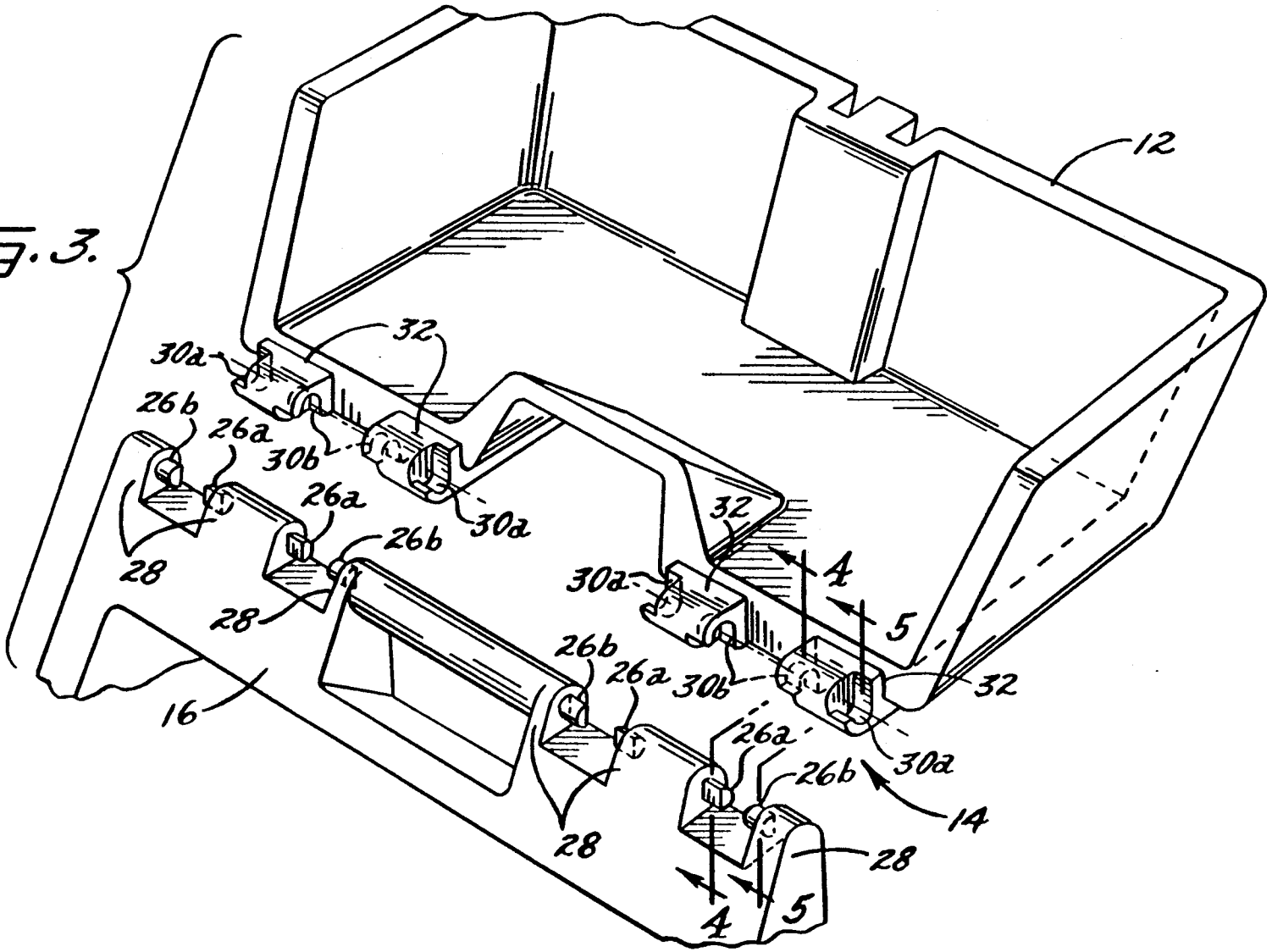
FIG. 3 is an enlarged partially exploded perspective view of the hinge interconnecting the top cover and back components of the case.

Referring now particularly to FIG. 3 of the drawings, the hinge means 14 interconnecting case components 12, 16 includes pintle means comprised of a plurality of pintle members 26*a*, 26*b* that are molded integrally with lugs 28 that project from the upper edge of rear wall component 16 of case 10. Hinge means 14 further includes hinge barrel means comprised of a plurality of hinge barrel members 30*a*, 30*b* that are integral with spaced lugs 32 upon the adjacent edge of cover component 12 of case 10. Pintle members 26*a*, 26*b* alternate with and are spaced from each other along the length of the axis of hinge 14. Each of the hinge pintle members 30*a*, 30*b* illustratively and preferably is of generally semi-circular shape and has a generally flat abutment surface 34 upon one side thereof, and a generally semi-circular abutment surface 36 upon the opposite side thereof. The abutment surfaces upon pintle members 26*a* face oppositely from the abutment surfaces of pintle members 26*b*. More specifically in the foregoing regard, the surfaces 34, 36 of pintle members 26*a* illustratively and respectively face (as viewed in FIG. 3) forwardly and rearwardly, while the surfaces 34, 36 of pintle members 26*b* respectively face in the opposite directions, i.e., rearwardly and forwardly. The abutment surfaces 34 upon such pintle members are substantially coplanar with each other and with a vertical plane containing the central axis of hinge 14.

Hinge barrel members 30*a*, 30*b* are located adjacent opposite ends of lugs 32 and each have a channel-shaped recess opening from an end and a side of the lug 32 with which it is associated. The recesses of barrel members 30*a* face in opposite directions from the recesses of barrel members 30*b*. In the orientation thereof shown in FIG. 3, the recesses of members 30*a* open from the top of the lug members 32, while the recesses of barrel members 30*b* open from the bottom of lugs 32. The recesses of members 30*a*, 30*b* are axially aligned with each other and with the central axis of hinge 14. The recess of each barrel member 30*a*, 30*b* preferably and illustratively extends through approximately 180° and terminates at the free end of the barrel member adjacent a generally flat surface 38, best shown in FIGS. 4 and 5. Surfaces 38 of barrel members 30*a* are substantially coplanar. The surfaces 38 of barrel members 30*b* are also substantially coplanar.

Figure 4A:
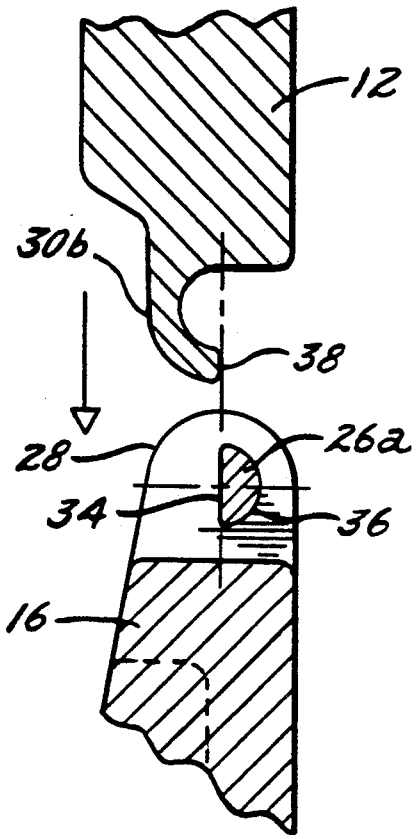
FIGS. 4*a*–4*d* are sequential sectional views taken in the direction of the arrows 4—4 of FIG. 3 and showing the relative movement between pintle and knuckle members of the hinge as they are brought into mating relationship and as they undergo relative pivotal movement.
Figure 4B:
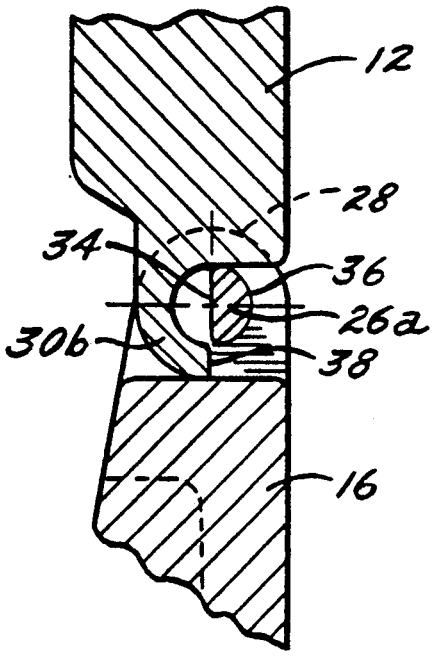
Figure 4C:
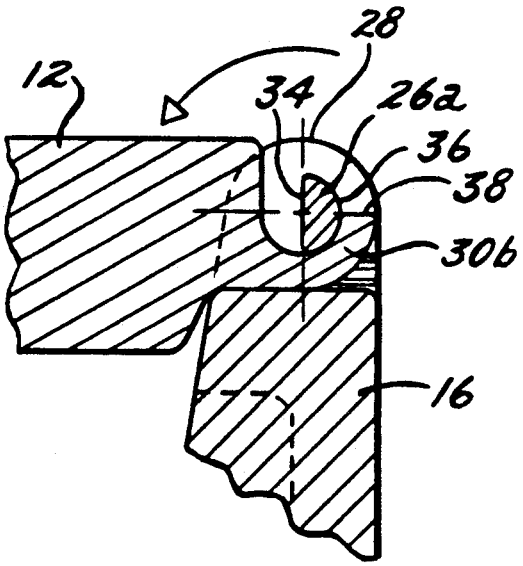
Figure 4D:
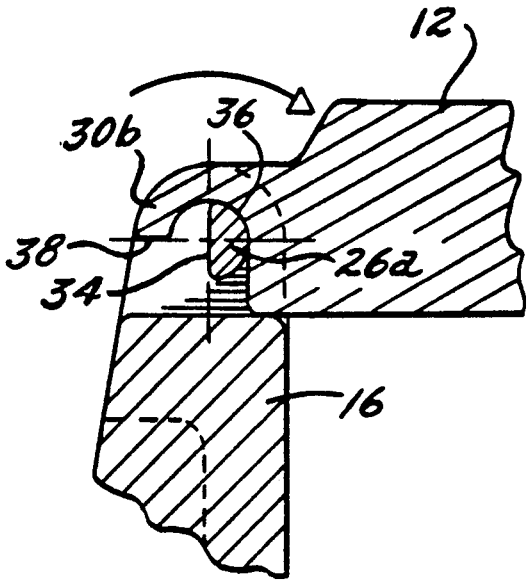
Figure 5A:
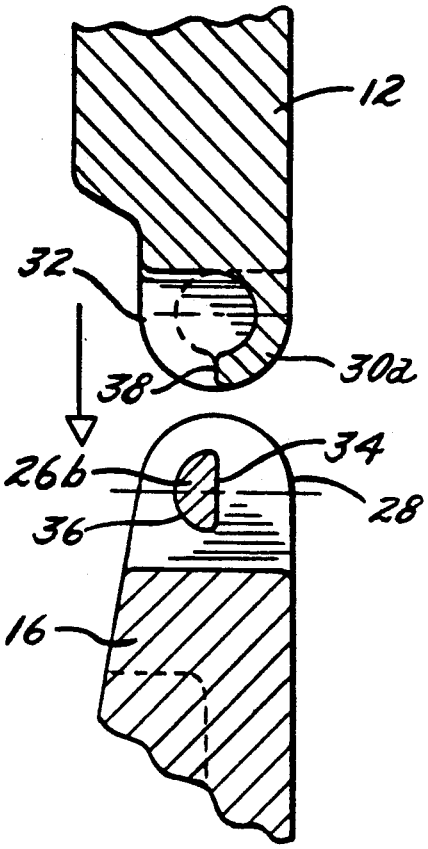
FIGS. 5*a*–5*d* are sectional views similar to FIG. 4 but taken along the line 5—5 of FIG. 3 through oppositely facing knuckle and pintle members of the hinge.

FIGS. 4*a*–4*d* and 5*a*–5*d* illustrate how the pintle members and barrel members of hinge 14 mate and interact with each other. As is indicated in FIGS. 4*a* and 5*a*, surfaces 38 of the hinge barrel members 30 upon case component 12 are brought into substantially coplanar relationship with thereto adjacent ones of the substantially flat surfaces 34 of the pintle members 26 upon case component 16. Downward movement of case component 12 then brings members 30 to their positions of FIGS. 4*b* and 5*b*, wherein the surface 38 of each barrel member 30*a* underlies the generally flat surface of the adjacent pintle member 26. Relative rotation between case components 12, 16 in either direction then secures the pintle members 26 and barrel members 30 together for relative pivotal movement. While the range of the relative pivotal movement illustrated in FIGS. 4 and 5 is 180°. (90° in either direction), the extent of the pivotal movement is limited only by abutment between surfaces of case components 12, 16 and, but for such abutment, could be 360°.

As is apparent from the foregoing, assembly of hinge 14 does not require a force or "snap" fit between any of the hinge components. This facilitates ease of assembly of the hinge, and enhances the useful life of the components thereof.

While the complementary semi-circular arcuate shape of the confronting surfaces of barrel members 30*a* and pintle members 26 provides maximum engagement between such members and thus enhances the stability of pivotal movement therebetween, such surfaces need not necessarily be of the illustrated complementary shapes.

The components of hinge means 14 can all be formed in simple molds without the use of movable mold components. This contributes significantly to the ease an economy of manufacture of the hinge.

Figure 5B:
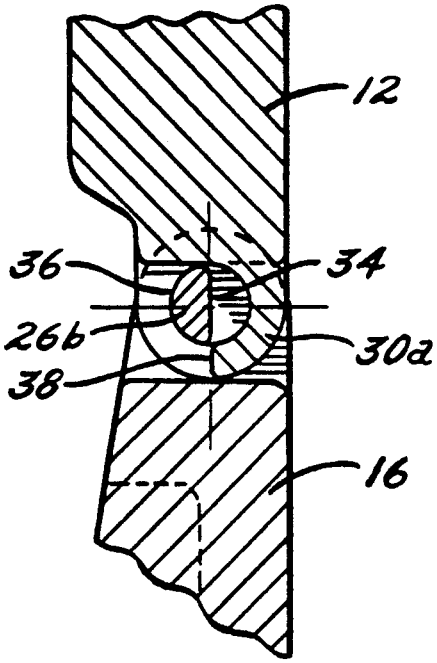
Figure 5C:
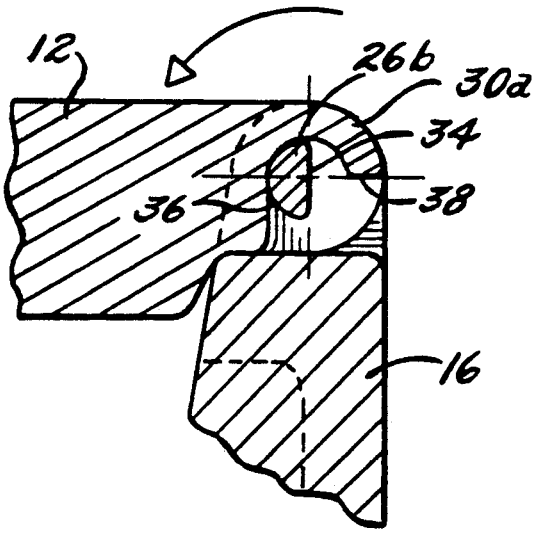
Figure 5D:
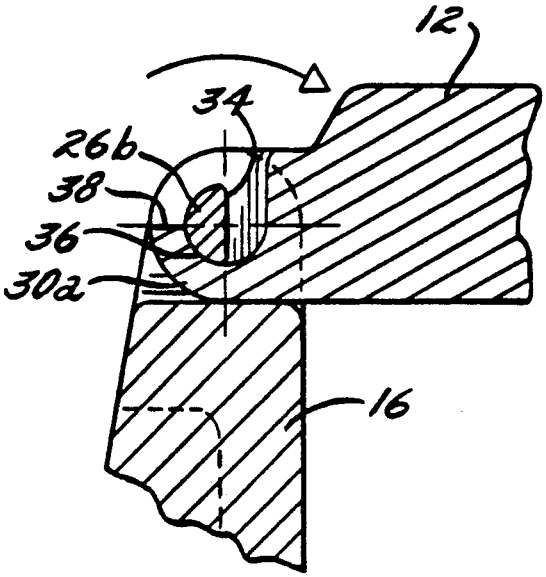

Disassembly of hinge 14 may be accomplished when desired by moving components 12, 16 to their positions shown in FIGS. 4*b* and 5*b*, and then to their positions shown in FIGS. 4*a* and 5*a*. Inadvertent disassembly of hinge 14 is unlikely to occur, since it can only ensue when the case components 12, 16 occupy a single precise position. If desired, detent means (not shown) may be provided in association with hinge 14, 14' to prevent disassembly thereof.

Figure 6:
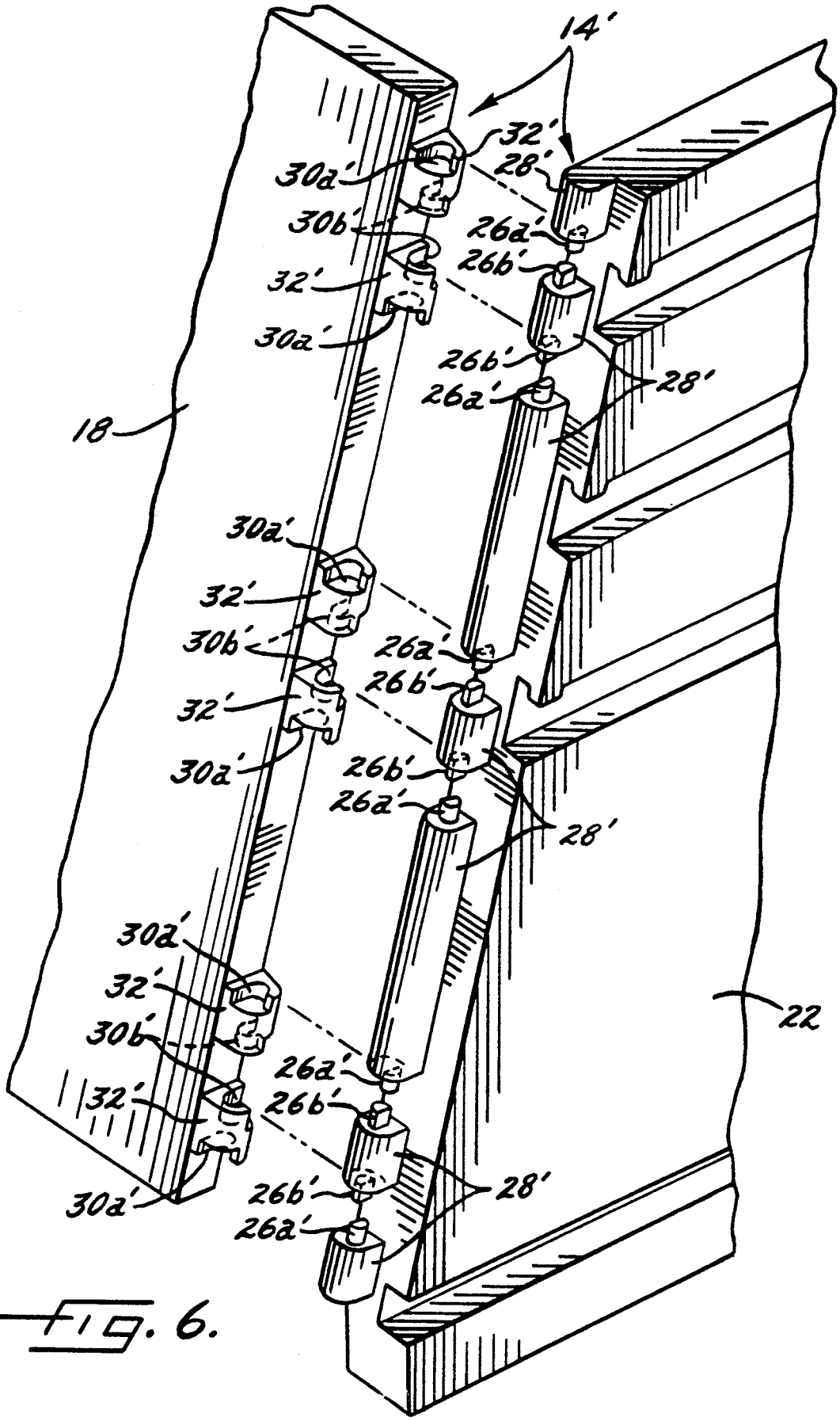
FIG. 6 is an enlarged exploded perspective view of the hinge interconnecting the left side and door components of the case.

As is apparent from FIG. 6 of the drawings, the hinge means 14' pivotally interconnecting the left door and side wall components 18, 22 of case 10 is comprised of hinge and pintle components of the same type as those of hinge 14, and have been given the same reference numerals with the addition of a prime designation. The hinge 14' interconnecting the right door and side wall components of case 10 is of substantially the same construction as the left hinge 14'. The hinge means of the present invention operates satisfactorily irrespective of the orientation of its central axis.

While a preferred embodiment of the present invention has been shown and described, this was for purposes of illustration only, and not for purposes of limitation, the scope of the invention being in accordance with the following claims.

I claim:

1. Hinge means for a molded plastic case having first and second components adapted to undergo relative pivotal movement about a pivot axis, comprising:

hinge pintle means integral with one of said components;

hinge knuckle means integral with the other of said components;

said hinge pintle means including a plurality of first and second axially extending and mutually spaced pintle members, each of said first pintle members having a generally semi-circular outer surface facing in a first direction and a generally flat surface facing in a second, opposite direction, each of said second pintle members having a generally semi-circular outer surface facing in said second direction and having a generally flat surface facing in said first direction;

said generally flat surfaces of said first and second pintle members being substantially coplanar with each other and with a plane containing said pivot axis;

said hinge knuckle means including a plurality of first and second axially aligned and mutually spaced knuckle members, said knuckle members each having a generally C-shaped configuration and defining a generally semi-circular recess having an entrance opening for receiving an adjacent one of said pintle members, said entrance openings of said first ones of said knuckle members facing in a first direction, and said entrance openings of said knuckle members of said second ones of said knuckle members facing in a second, opposite direction, said hinge pintle members and said hinge knuckle members being connectable to each other by bringing said substantially flat surfaces of said pintle members into confronting, substantially coplanar relationship with respective ones of said entrance openings of said knuckle members, and then effecting relative rotation between said pintle members and said knuckle members;

a plurality of lugs upon said components of said case, said pintle members being integral with and projecting from ends of said lugs upon one of said components, and said knuckle members being integral with said lugs upon the other of said case components; and wherein at least some of said lugs upon said other component of said case have first and second knuckle members adjacent respective first and second ends thereof.

2. Hinge means as in claim 1, wherein each of said first and second knuckle members includes a channel opening from one end lug and extending therefrom toward the opposite end of said lug.

3. Hinge means as in claim 2, wherein said channels of said knuckle members of each of said lugs are axially spaced non-communicating relationship with each other.

* * * * *